US010654152B2

(12) United States Patent
Xiong

(10) Patent No.: US 10,654,152 B2
(45) Date of Patent: May 19, 2020

(54) PRESS TYPE AUTOMATIC SCREWDRIVER

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Biao Xiong, Shen Zhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 250 days.

(21) Appl. No.: 15/730,829

(22) Filed: Oct. 12, 2017

(65) Prior Publication Data

US 2019/0076996 A1 Mar. 14, 2019

(30) Foreign Application Priority Data

Sep. 11, 2017 (CN) ..... 2017 1 0813394

(51) Int. Cl.
*B25B 17/00* (2006.01)
*B25B 15/06* (2006.01)

(52) U.S. Cl.
CPC ..... *B25B 17/00* (2013.01); *B25B 15/06* (2013.01)

(58) Field of Classification Search
CPC ..... B25B 15/06; B25B 17/00
USPC ..... 81/57, DIG. 2; 74/127
See application file for complete search history.

(56) References Cited

U.S. PATENT DOCUMENTS 2,646,687 A * 7/1953 De Wald ..... F16H 25/122 74/127
2,664,126 A * 12/1953 Mansfield ..... B25B 13/463 74/127
3,789,896 A * 2/1974 Cooke-Yarborough ..... B25B 15/06 74/127
9,815,181 B2 * 11/2017 Yang ..... B25B 15/06

* cited by examiner

*Primary Examiner* — Monica S Carter
*Assistant Examiner* — Abbie E Quann
(74) *Attorney, Agent, or Firm* — ScienBiziP, P.C.

(57) ABSTRACT

A press type automatic screwdriver includes a press member, a drive link, a screwdriver bit, and a screw thread pair including a screw rack and a gear engaged with the screw rack. The press member and the screwdriver bit are secured to opposite ends of the drive link, the press member and the drive link are connected by the screw thread pair, and the screw rack is resisted by the press member. The gear is secured on an end of the drive link. When the press member is pressed, the press member pushes the screw rack, the screw rack drives the gear to rotate, the gear drives the drive link to rotate, and the drive link drives the screwdriver bit to rotate.

9 Claims, 7 Drawing Sheets

PRESS TYPE AUTOMATIC SCREWDRIVER

FIELD

The subject matter herein generally relates to hand tools, and particularly to a press type automatic screwdriver.

BACKGROUND

Screwdrivers are widely used to assemble screws onto a workpiece or dismantle screws. The existing screwdriver is a hand-operated screwdriver or an electric screwdriver. When the hand-operated screwdriver is used to assemble or dismantle screws, a user rotates the hand-operated screwdriver hardly, and sometimes needs to use two hands to handle the hand-operated screwdriver. An electric screwdriver can assemble or dismantle screws automatically, but the electric screwdriver is heavy and large, so the electric screwdriver is not easy to carry. Thus an automatic screwdriver with light weight and small volume is needed.

BRIEF DESCRIPTION OF THE DRAWINGS

Implementations of the present disclosure will now be described, by way of example only, with reference to the attached figures.

DETAILED DESCRIPTION

Figure 1:
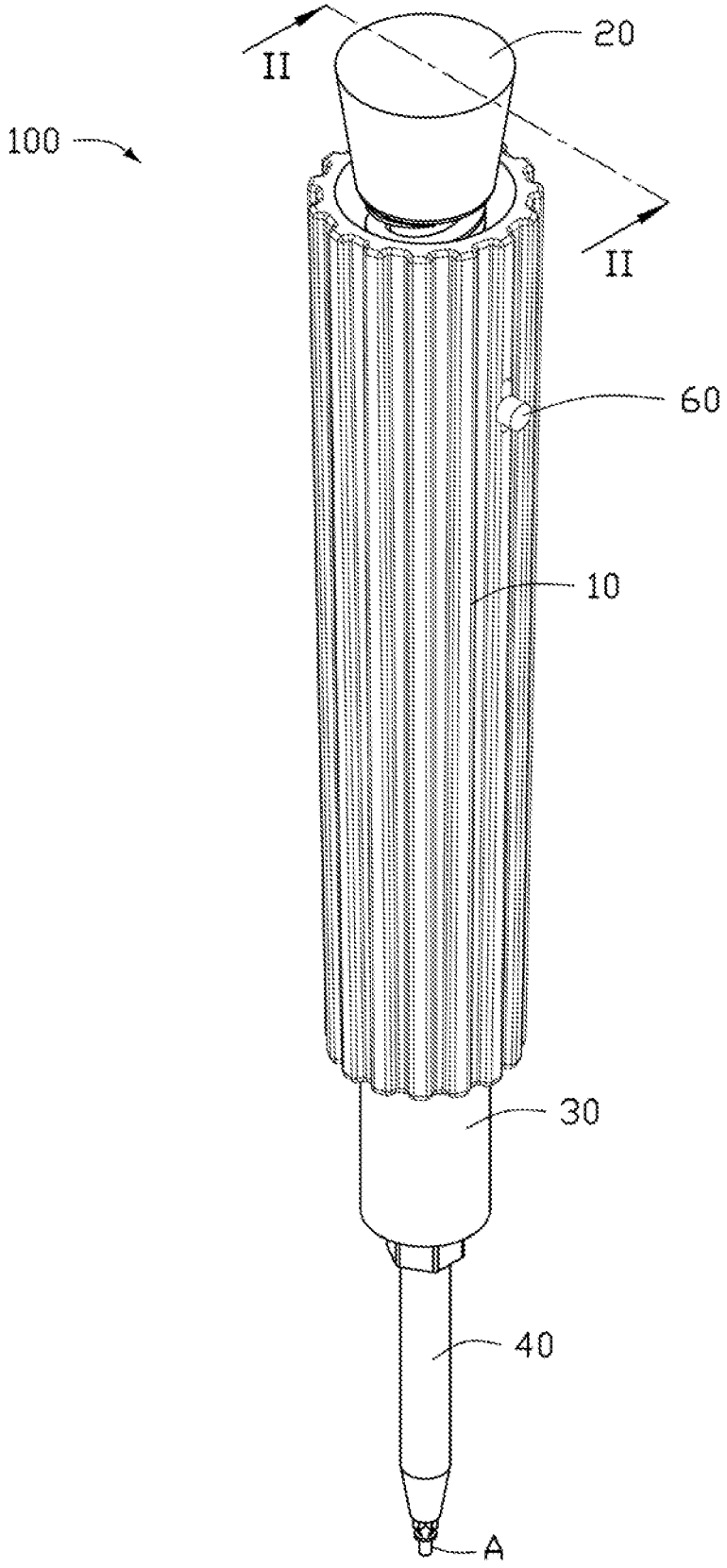
FIG. 1 is a diagram of an exemplary embodiment of a press type automatic screwdriver.

It will be appreciated that for simplicity and clarity of illustration, where appropriate, reference numerals have been repeated among the different figures to indicate corresponding or analogous elements. In addition, numerous specific details are set forth to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to illustrate details and features of the present disclosure better. The disclosure is illustrated by way of example and not by way of limitation in the figures of the accompanying drawings, in which like references indicate similar elements. It should be noted that references to "an" or "one" embodiment in this disclosure are not necessarily to the same embodiment, and such references mean "at least one."

The term "comprising" when utilized, means "including, but not necessarily limited to"; it specifically indicates open-ended inclusion or membership in the so-described combination, group, series, and the like.

Figure 2:
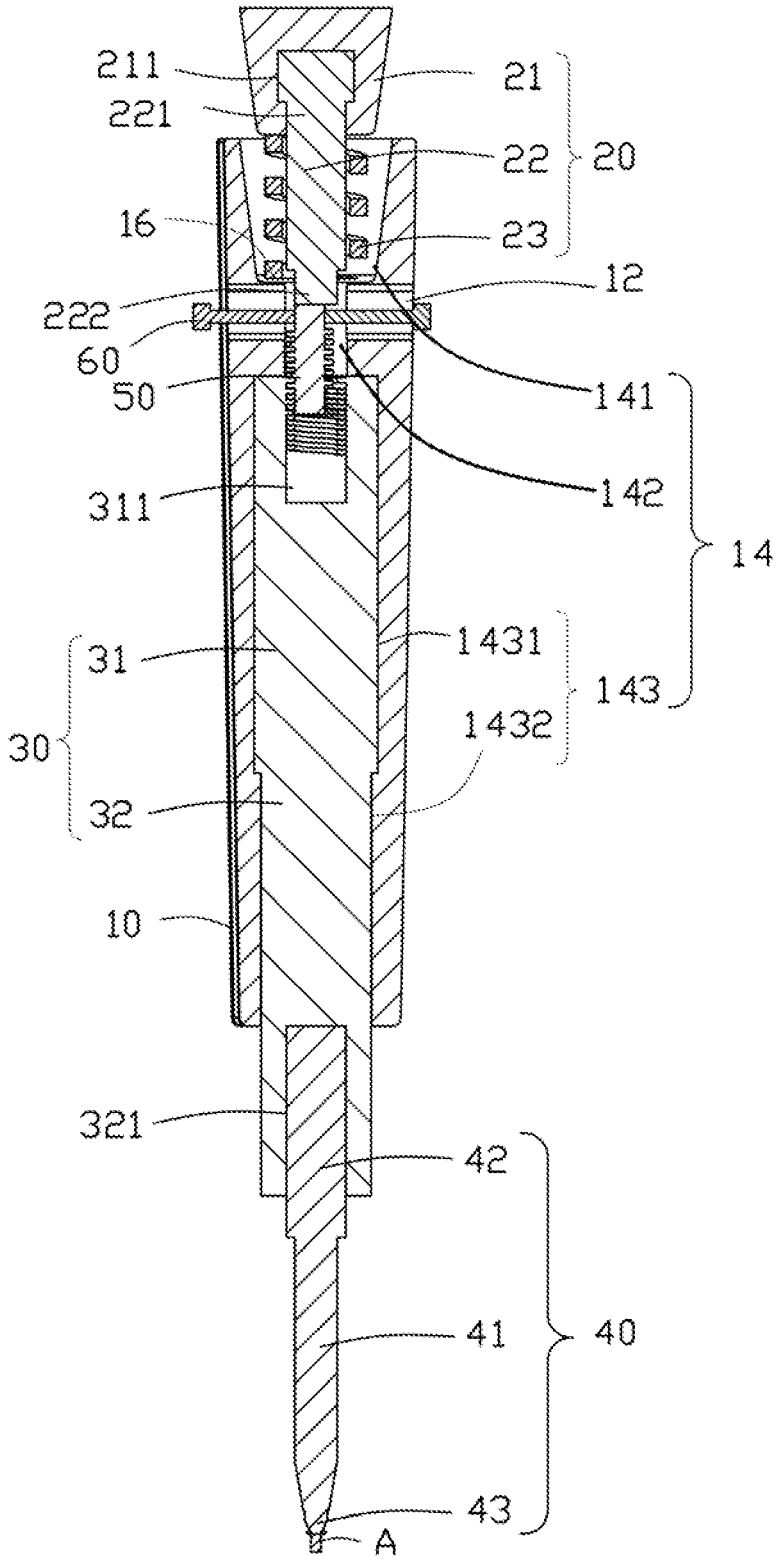
FIG. 2 is a cross-sectional view taken along line II-II of FIG. 1.

FIG. 1 and FIG. 2 illustrate an exemplary embodiment of a press type automatic screwdriver 100. The press type automatic screwdriver 100 is configured to assemble or dismantle a screw A. The press type automatic screwdriver 100 includes a sleeve 10, a press member 20, a drive link 30, a screwdriver bit 40, and a screw thread pair 50. The sleeve 10 is placed over the drive link 30. The press member 20 and the screwdriver bit 40 are secured to opposite ends of the drive link 30. The press member 20 and the drive link 30 are connected by the screw thread pair 50.

Figure 3:
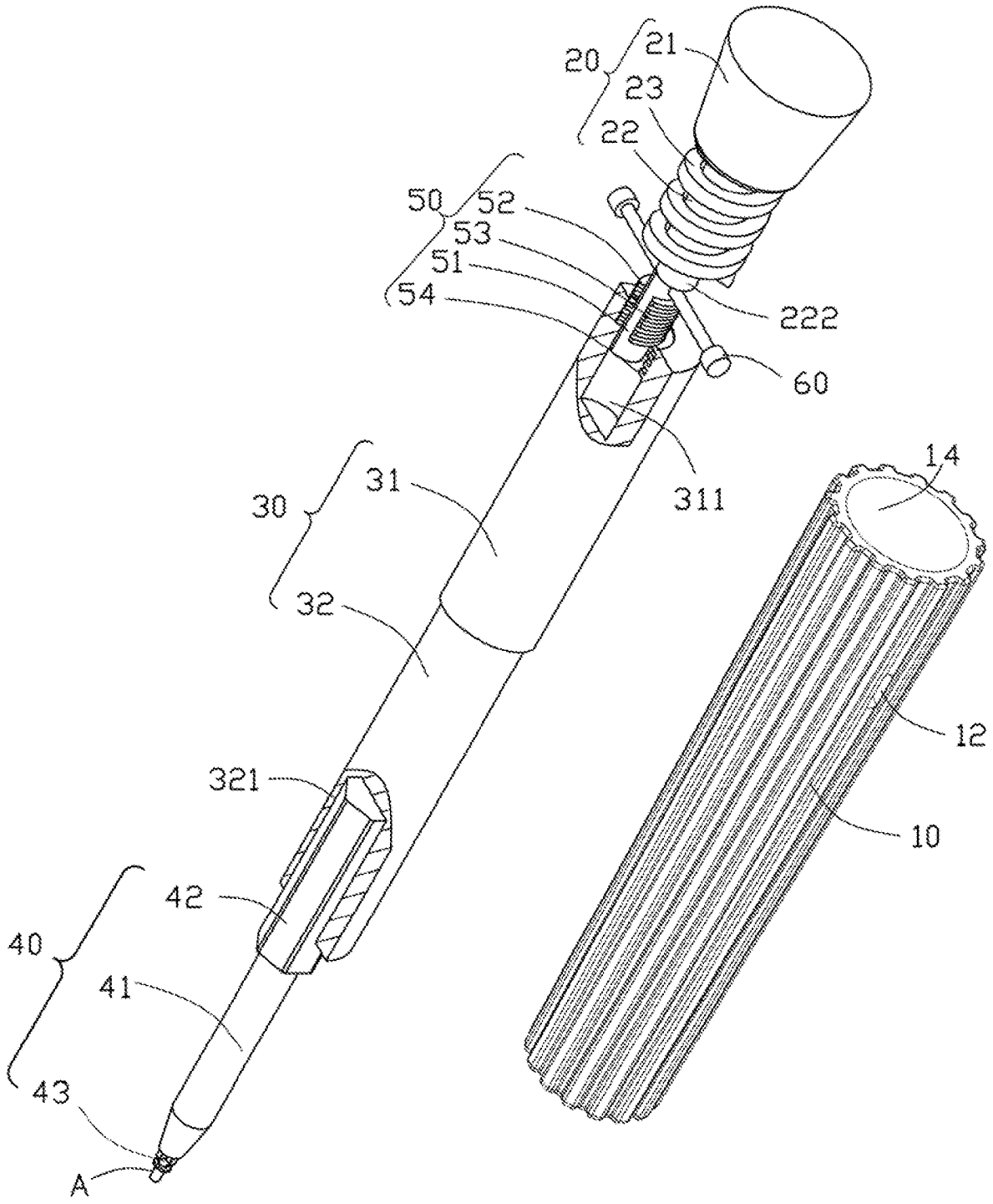
FIG. 3 is an exploded perspective view of the press type automatic screwdriver of FIG. 1.

Referring to FIG. 3, the sleeve 10 defines two through holes 12. The two through holes 12 are coaxially opposite to each other. The sleeve 10 defines a cavity 14. The cavity 14 includes a first receiving space 141, a second receiving space 142 being adjacent to and in communication with the first receiving space 141, and a third receiving space 143 being adjacent to and in communication with the second receiving space 142. A portion of the press member 20 is received in the first receiving space 141. At least a portion of the drive link 30 is received in the third receiving space 143. A portion of the screw thread pair 50 is received in the second receiving space 142. The press member 20 is aligned with the second receiving space 142.

The sleeve 10 further includes an annular convex stage 16 formed in the cavity 14. The annular convex stage 16 is placed around the second receiving space 142, and separates the first receiving space 141 and the third receiving space 143.

The third receiving space 143 includes a first receiving portion 1431 being adjacent to and in communication with the second receiving space 142, and a second receiving portion 1432 being adjacent to and in communication with the first receiving portion 1431. A diameter of the first receiving portion 1431 is bigger than a diameter of the second receiving portion 1432.

Figure 4:
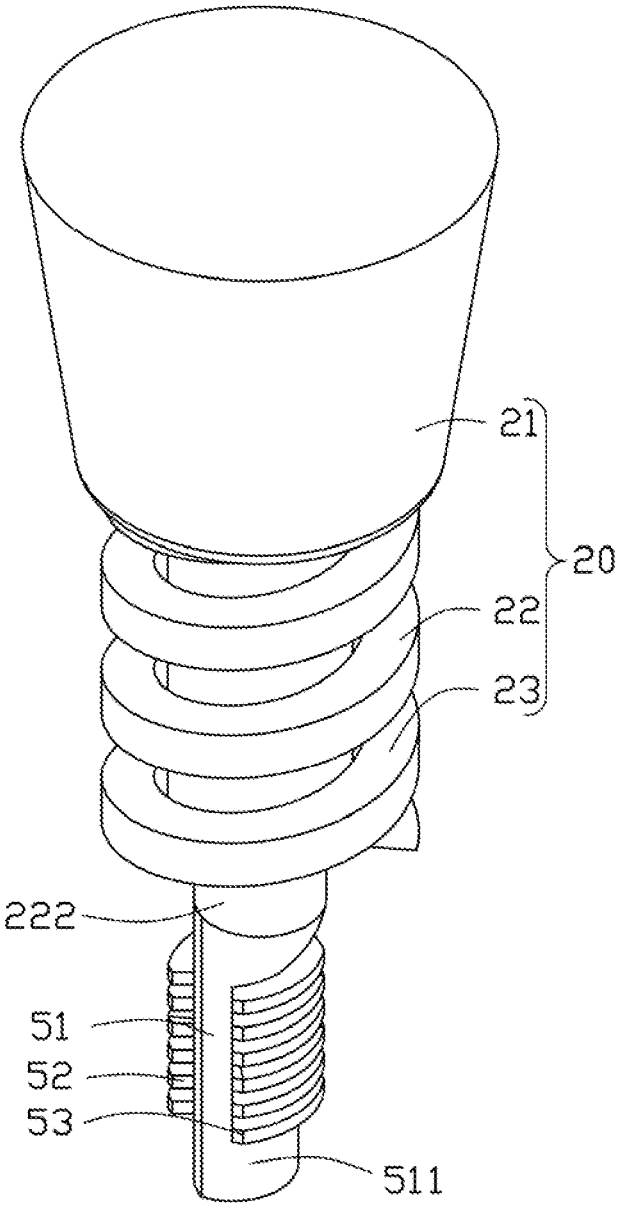
FIG. 4 is a diagram of an exemplary embodiment of a press piece of the press type automatic screwdriver of FIG. 1.

Referring to FIG. 4, the press member 20 includes a press head 21, a press rod 22, and an elastic member 23. The press head 21 defines an inserting hole 211. The press rod 22 includes a first end 221 and a second end 222 opposite to the first end 221. The first end 221 is inserted in the inserting hole 211. The second end 222 is received in the second receiving space 142, and resists to the screw thread pair 50. The elastic member 23 is placed over the press rod 22, and received in the first receiving space 141. One end of the elastic member 23 is resisted to the press head 21, and the other end of the elastic member 23 is resisted to the annular convex stage 16. When the press head 21 is pressed, the second end 222 of the press rod 22 will move in the second receiving space 142 toward the third receiving space 143, the elastic member 23 will be compressed by the press head 21 and the annular convex stage 16. When the pressing stops, the compressed elastic member 23 will push the press head 21 to move in a direction away from the annular convex stage 16, until the elastic member 23 recovers to its original length.

In at least one exemplary embodiment, the elastic member 23 is a spring.

Figure 5:
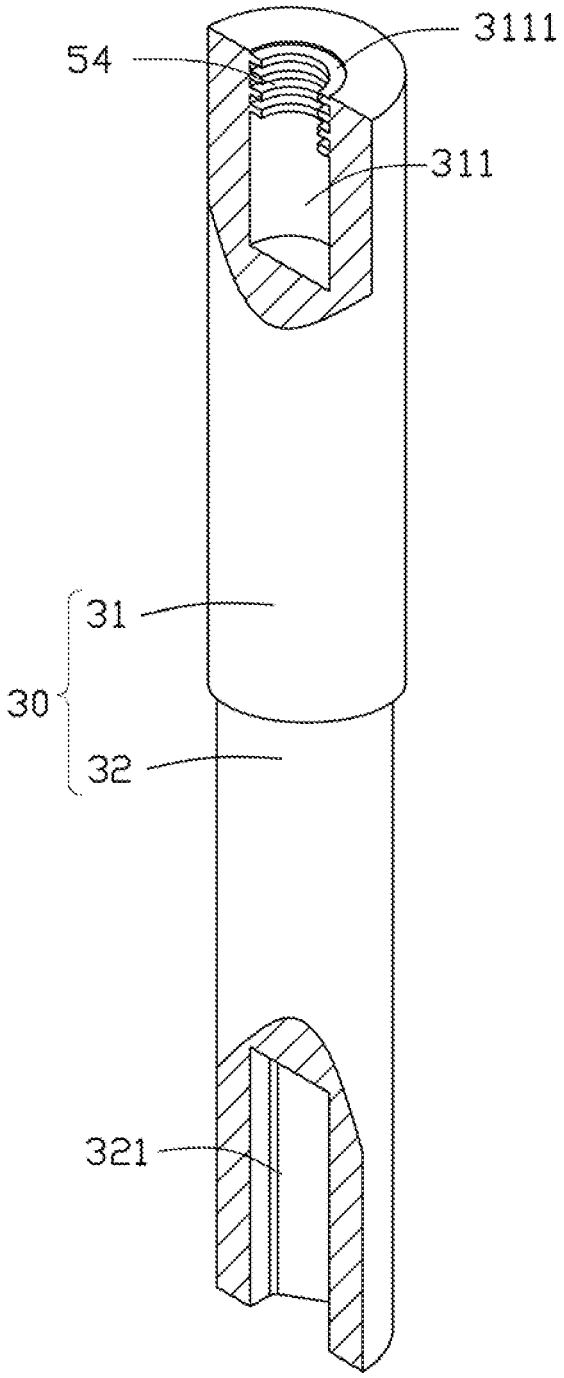
FIG. 5 is a diagram of an exemplary embodiment of a drive link of the press type automatic screwdriver of FIG. 1.

Referring to FIG. 5, the drive link 30 includes a first drive link 31 and a second drive link 32 connected with the first drive link 31. A diameter of the first drive link 31 is greater than a diameter of the second drive link 32. The first drive link 31 is received in the first receiving portion 1431, and at least a portion of the second drive link 32 adjacent to the first drive link 31 is received in the second receiving portion 1432. An end of the first drive link 31 away from the second drive link 32 defines a first mounting hole 311. An end of the second drive link 32 away from the first drive link 31 defines a second mounting hole 321. A portion of the screw thread pair 50 is mounted in the first mounting hole 311. An end of the screwdriver bit 40 is mounted in the second mounting hole 321. The first mounting hole 311 has an opening 3111.

Figure 6:
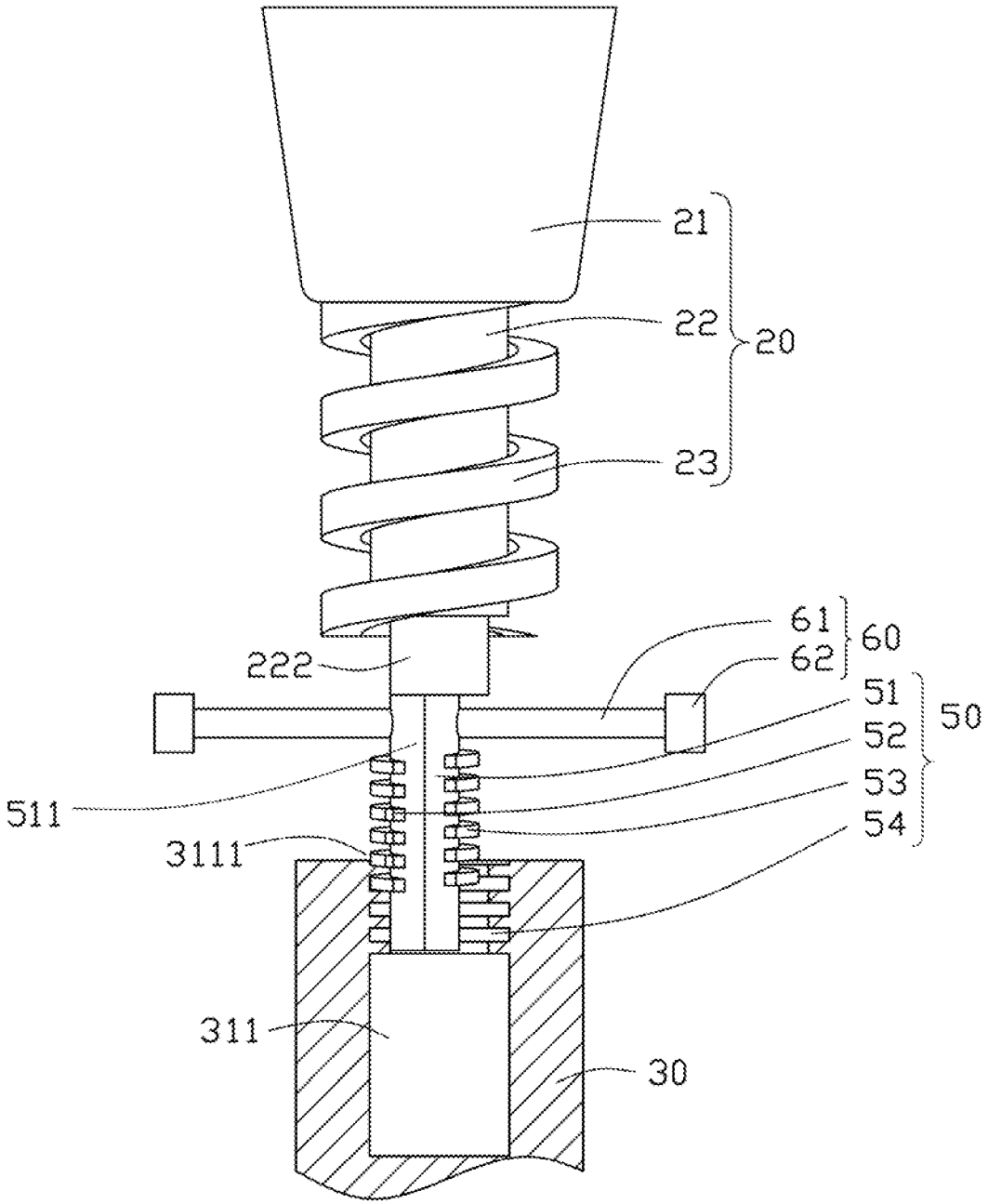
FIG. 6 is a diagram of an exemplary embodiment of a screw thread pair of the press type automatic screwdriver of FIG. 3.

Referring to FIG. 6, the screw thread pair 50 includes a cylindrical body 51, a first rotating screw rack 52, a second rotating screw rack 53, and an inner gear 54. One end of the cylindrical body 51 is received in the first mounting hole 311, the other end of the cylindrical body 51 is received in the second receiving space 142, and resisted by the second end 222 of the press rod 22. The cylindrical body 51 includes a side surface 511. The first rotating screw rack 52 and the second rotating screw rack 53 are juxtaposed on the side surface 511. The inner gear 54 is secured on an inner surface of the first mounting hole 311, and the inner gear 54 is contiguous with the opening 3111. Teeth of the first rotating screw rack 52 can engage with those of the inner gear 54, and teeth of the second rotating screw rack 53 can engage with those of the inner gear 54. When the teeth of the first rotating screw rack 52 are engaged with those of the inner gear 54, the second rotating screw rack 53 is away from the inner gear 54; when the press member 20 is pressed, the press member 20 will push the screw thread pair 50, the first rotating screw rack 52 will drive the inner gear 54 to rotate in a first direction, the inner gear 54 will drive the drive link 30 to rotate in the first direction, and the screwdriver bit 40 will rotate along with the drive link 30 in the first direction. When the teeth of the second rotating screw rack 53 are engaged with those of the inner gear 54, the first rotating screw rack 52 is away from the inner gear 54; when the press member 20 is pressed, the press member 20 will push the screw thread pair 50, the second rotating screw rack 53 will drive the inner gear 54 to rotate in a second direction, opposite to the first direction, the inner gear 54 will drive the drive link 30 to rotate in the second direction, and the screwdriver bit 40 will rotate along with the drive link 30 in the second direction. In at least one exemplary embodiment, the first direction is a positive rotating direction, and the second direction is a counter rotating direction.

The press type automatic screwdriver 100 further includes two switchover members 60. Each one of the two switchover members 60 is slidably inserted through one of the two through holes 12, and at least a portion of each of the two switchover members 60 extends out from one of the two through holes 12. One of the two switchover members 60 is set at the same side of the cylindrical body 51 as the first rotating screw rack 52, and the other one of the two switchover members 60 is set at the same side of the cylindrical body 51 as the second rotating screw rack 53. In other words, one switchover member 60 is aligned with the first rotating screw rack 52, and the other switchover member 60 is aligned with the second rotating screw rack 53. When the switchover member 60 aligned with the second rotating screw rack 53 is pushed, the switchover member 60 will push the cylindrical body 51 to move, the cylindrical body 51 will engage the first rotating screw rack 52 with the inner gear 54, and the second rotating screw rack 53 will be away from the inner gear 54; when the press member 20 is pressed, the press member 20 will push the screw thread pair 50, the first rotating screw rack 52 will drive the inner gear 54 to rotate in the first direction, the inner gear 54 will drive the drive link 30 to rotate in the first direction, and the screwdriver bit 40 will rotate along with the drive link 30 in the first direction. When the switchover member 60 aligned with the first rotating screw rack 52 is pushed, the switchover member 60 will push the cylindrical body 51 to move, the cylindrical body 51 will move to engage the second rotating screw rack 53 with the inner gear 54, and the first rotating screw rack 52 will be away from the inner gear 54; when the press member 20 is pressed, the press member 20 will push the screw thread pair 50, the second rotating screw rack 53 will drive the inner gear 54 to rotate in the second direction, opposite to the first direction, the inner gear 54 will drive the drive link 30 to rotate in the second direction, and the screwdriver bit 40 will rotate along with the drive link 30 in the second direction.

In at least one exemplary embodiment, the switchover member 60 includes a push rod 61 and a head portion 62 secured to one end of the push rod 61. The push rod 61 of each one of the switchover members 60 is slidably inserted through one of the two through holes 12, and each of the two head portions 62 extends out from the one of the two through holes 12.

Figure 7:
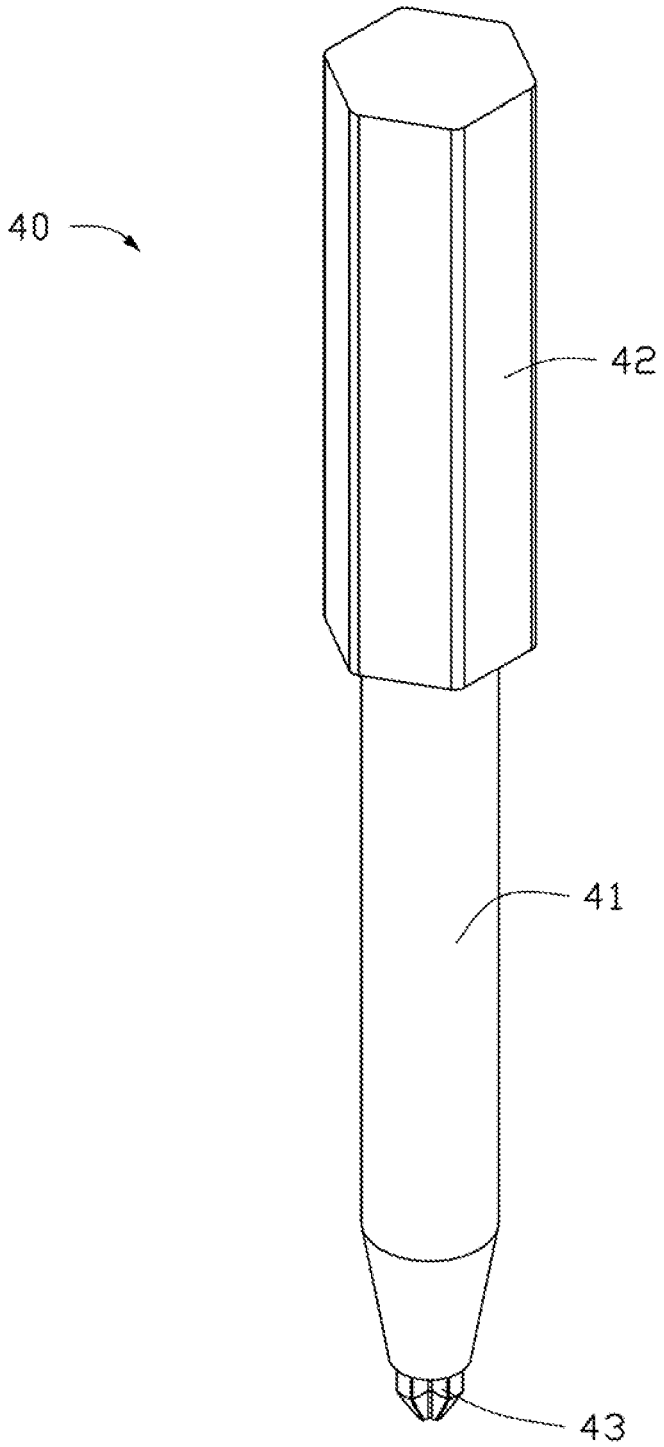
FIG. 7 is a diagram of an exemplary embodiment of a screwdriver bit of the press type automatic screwdriver of FIG. 1

Referring to FIG. 7, the screwdriver bit 40 includes a connecting portion 41, an inserting portion 42, and a screw head 43. The inserting portion 42 and the screw head 43 are secured on opposite ends of the connecting portion 41. The inserting portion 42 is mounted in the second mounting hole 321. The screw head 43 is configured to assemble or dismantle the screw A.

When the press type automatic screwdriver 100 is used to assemble screw A, and the screw A being assembled needs to rotate in a positive rotating direction. First, pressing the head portion 62 of the switchover member 60 aligned with the second rotating screw rack 53, the push rod 61 secured to the head portion 62 will push the cylindrical body 51 to move, the cylindrical body 51 will engage the first rotating screw rack 52 with the inner gear 54, and the second rotating screw rack 53 will be away from the inner gear 54. The elastic member 23 of the press member 20 is in an original length now.

Then, the user presses the press head 21 of the press member 20, and the press rod 22 will move in the cavity 14, and the second end 222 of the press rod 22 will move in the second receiving space 142 toward the third receiving space 143, and the elastic member 23 will be compressed by the press head 21 and the annular convex stage 16. At the same time, the second end 222 of the press rod 22 will push the cylindrical body 51. The press rod 22 will push the cylindrical body 51, the first rotating screw rack 52 will drive the inner gear 54 to rotate in the first direction, the inner gear 54 will drive the drive link 30 to rotate in the first direction, and the screwdriver bit 40 will rotate along with the drive link 30 in the first direction. Thus the screw head 43 of the screwdriver bit 40 will drive the screw A to rotate in the first direction.

Then, stop pressing the press head 21, and the compressed elastic member 23 will push the press head 21 to move in a direction away from the annular convex stage 16, until the elastic member 23 recovers to its original length.

Then repeat the pressing and stopping pressing process, the screw A will be assembled.

When the press type automatic screwdriver 100 is used to dismantle screw A, and the screw A being dismantled needs to rotate in a counter rotating direction. First, pressing the head portion 62 of the switchover member 60 aligned with first rotating screw rack 52, the push rod 61 secured to the head portion 62 will push the cylindrical body 51 to move, the cylindrical body 51 will engage the second rotating screw rack 53 with the inner gear 54, and the first rotating screw rack 52 will be away from the inner gear 54. The elastic member 23 of the press member 20 is in an original length now.

Then, the user presses the press head 21 of the press member 20, and the press rod 22 will move in the cavity 14, and the second end 222 of the press rod 22 will move in the second receiving space 142 toward the third receiving space 143, and the elastic member 23 will be compressed by the press head 21 and the annular convex stage 16. At the same time, the second end 222 of the press rod 22 will push the cylindrical body 51. The press rod 22 will push the cylindrical body 51, the second rotating screw rack 53 will drive the inner gear 54 to rotate in the second direction, the inner gear 54 will drive the drive link 30 to rotate in the second direction, and the screwdriver bit 40 will rotate along with the drive link 30 in the second direction. Thus the screw head 43 of the screwdriver bit 40 will drive the screw A to rotate in the second direction.

Then, stop pressing the press head 21, and the compressed elastic member 23 will push the press head 21 to move in a direction away from the annular convex stage 16, until the elastic member 23 recovers to its original length.

Then repeat the pressing and stopping pressing process, the screw A will be dismantled.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A press type automatic screwdriver comprising:

a press member;

a drive link;

a screwdriver bit; and a screw thread pair, the screw thread pair comprising a screw rack and a gear engaged with the screw rack;

wherein the press member and the screwdriver bit are secured to opposite ends of the drive link, the press member and the drive link are connected by the screw thread pair, the screw rack is resisted by the press member, the gear is secured on an end of the drive link; and wherein when the press member is pressed, the press member pushes the screw rack, the screw rack drives the gear to rotate, the gear drives the drive link to rotate, and the drive link drives the screwdriver bit to rotate;

wherein the screw rack comprises a first rotating screw rack and a second rotating screw rack, the first rotating screw rack and the second rotating screw rack are juxtaposed, the gear is engaged with the first rotating screw rack or the second rotating screw rack;

wherein the press type automatic screwdriver further comprises two switchover members, one of the two switchover members is aligned with the first rotating screw rack, and the other one of the two switchover members is aligned with the second rotating screw rack, when the one of the two switchover members aligned with the first rotating screw rack is pushed, the other one of the two switchover members pushes the screw rack to move to make the second rotating screw rack engage with the gear, and to make the first rotating screw rack away from the gear; when the other one of the two switchover members aligned with the second rotating screw rack is pushed, the one of the two switchover members pushes the screw rack to move to make the first rotating screw rack engage with the gear, and to make the second rotating screw rack away from the gear.

2. The press type automatic screwdriver of claim 1, wherein the press type automatic screwdriver further comprises a sleeve, the sleeve defines a cavity, the cavity defines a first receiving space, a second receiving space being adjacent to and in communication with the first receiving space, and a third receiving space being adjacent to and in communication with the second receiving space, a portion of the press member is received in the first receiving space, a portion of the screw rack is received in the second receiving space, and at least a portion of the drive link is received in the third receiving space, the press member is aligned with the second receiving space.

3. The press type automatic screwdriver of claim 2, wherein the sleeve defines two through holes, the two through holes are coaxially opposite to each other, each one of the two switchover members is slidably inserted through one of the two through holes, and an end of the each of the two switchover members extends out from the one of the two through holes.

4. The press type automatic screwdriver of claim 2, wherein the press member comprises a press head, a press rod secured to the press head, and an elastic member placed over the press rod, the sleeve further comprises an annular convex stage formed in the cavity, the annular convex stage is placed around the second receiving space, and separates the first receiving space and the second receiving space, the elastic member is received in the first receiving space, one end of the elastic member is resisted to the press head, and the other end of the elastic member is resisted to the annular convex stage, the press rod is aligned with the second receiving space, when the press head is pressed, the press head pushes the press rod to move along with the second receiving space toward the third receiving space, the elastic member is compressed by the press head and the annular convex stage.

5. The press type automatic screwdriver of claim 4, wherein the elastic member is a spring.

6. The press type automatic screwdriver of claim 2, wherein the drive link defines a first mounting hole and a second mounting hole, the first mounting hole and the second mounting hole are defined on opposite ends of the drive link, the gear is secured on an inner surface of the first mounting hole, an end of the screwdriver bit is mounted in the second mounting hole.

7. The press type automatic screwdriver of claim 6, wherein the first mounting hole comprises an opening, the gear is contiguous with the opening.

8. The press type automatic screwdriver of claim 6, wherein the drive link comprises a first drive link and a second drive link connected with the first drive link, a diameter of the first drive link is bigger than a diameter of the second drive link, the third receiving space comprises a first receiving portion being adjacent to and in communication with the second receiving space, and a second receiving portion being adjacent to and in communication with the first receiving portion, the first drive link is received in the first receiving portion, at least a portion of the second drive link adjacent to the first drive link is received in the second receiving portion.

9. The press type automatic screwdriver of claim 6, wherein the screwdriver bit comprises an inserting portion, and a screw head secured to the inserting portion, the inserting portion is mounted in the second mounting hole.

* * * * *